US010138887B2

(12) United States Patent
Yosuke

(10) Patent No.: US 10,138,887 B2
(45) Date of Patent: Nov. 27, 2018

(54) SCROLL COMPRESSOR

(71) Applicant: DAIKIN INDUSTRIES, LTD., Osaka-shi, Osaka (JP)

(72) Inventor: Yoshinobu Yosuke, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 410 days.

(21) Appl. No.: 14/899,034

(22) PCT Filed: May 7, 2014

(86) PCT No.: PCT/JP2014/002419
§ 371 (c)(1),
(2) Date: Dec. 16, 2015

(87) PCT Pub. No.: WO2014/203443
PCT Pub. Date: Dec. 24, 2014

(65) Prior Publication Data

US 2016/0123324 A1 May 5, 2016

(30) Foreign Application Priority Data

Jun. 20, 2013 (JP) ..... 2013-129355

(51) Int. Cl.
*F04C 18/02* (2006.01)
*F04C 27/00* (2006.01)

(52) U.S. Cl.
CPC ..... *F04C 18/0223* (2013.01); *F04C 18/0215* (2013.01); *F04C 18/0253* (2013.01); *F04C 27/005* (2013.01)

(58) Field of Classification Search
CPC ..... F04C 18/0223; F04C 18/0215; F04C 18/0253; F04C 27/005; F04C 18/0261
(Continued)

(56) References Cited

U.S. PATENT DOCUMENTS 4,645,437 A * 2/1987 Sakashita ..... F04C 18/0215 277/399
4,938,669 A * 7/1990 Fraser, Jr. ..... F04C 18/0215 418/55.5
(Continued)

FOREIGN PATENT DOCUMENTS

JP 60-104787 A 6/1985
JP 2-238189 A 9/1990
(Continued)

OTHER PUBLICATIONS

International Preliminary Report of corresponding PCT Application No. PCT/JP2014/002419 dated Dec. 22, 2015.
(Continued)

*Primary Examiner* — Phuttiwat Wongwian
*Assistant Examiner* — Kelsey Stanek
(74) *Attorney, Agent, or Firm* — Global IP Counselors, LLP

(57) ABSTRACT

A scroll compressor includes fixed and movable scrolls, a crank shaft and a housing. An outer peripheral portion of a top surface of the housing has an accommodation portion recessed and accommodating an Oldham coupling preventing rotations of the movable scroll around an axis. The housing has inner and outer seal ring grooves in a top surface. Inner and outer seal rings are fitted in the grooves. A portion of the top surface of the housing defined by the inner and outer seal ring grooves is higher than a surface that is closer to the inner periphery of the housing than the inner seal ring groove, and a surface that is closer to an outer periphery of the housing than the outer seal ring groove. The portion of the top surface serves as a tilt limiting surface.

16 Claims, 6 Drawing Sheets

(58) Field of Classification Search
USPC ..... 418/55.4
See application file for complete search history.

(56) References Cited

U.S. PATENT DOCUMENTS

| | | | | |
|---|---|---|---|---|
| 6,149,413 | A | 11/2000 | Lifson | |
| 2012/0164014 | A1* | 6/2012 | Nagahara | F04C 18/0215 418/55.1 |
| 2013/0129550 | A1* | 5/2013 | Hirawatari | F01C 21/02 418/55.1 |
| 2013/0189144 | A1 | 7/2013 | Yamamoto et al. | |

FOREIGN PATENT DOCUMENTS

| | | | |
|---|---|---|---|
| JP | 11-324945 | A | 11/1999 |
| JP | 2000-104678 | A | 4/2000 |
| JP | 2004-19527 | A | 1/2004 |
| JP | 2012-117519 | A | 6/2012 |

OTHER PUBLICATIONS

European Search Report of corresponding EP Application No. 14 81 3830.8 dated Feb. 20, 2017.
International Search Report of corresponding PCT Application No. PCT/JP2014/002419 dated Aug. 12, 2014.

* cited by examiner

SCROLL COMPRESSOR

CROSS-REFERENCE TO RELATED APPLICATIONS

This U.S. National stage application claims priority under 35 U.S.C. § 119(a) to Japanese Patent Application No. 2013-129355, filed in Japan on Jun. 20, 2013, the entire contents of which are hereby incorporated herein by reference.

TECHNICAL FIELD

The present invention relates to a scroll compressor.

BACKGROUND ART

Scroll compressors having a fixed scroll and a movable scroll with spirally-arranged wraps engaged with each other have been known (see, e.g., Japanese Unexamined Patent Publication No. 2012-117519). A housing is disposed on the back surface of the movable scroll, and an Oldham coupling, which prevents the movable scroll from rotating on its own axis, is disposed between the end plate of the movable scroll and the housing. In this scroll compressor, a low-pressure gas is taken in and compressed, while a compression chamber formed between the wrap of the fixed scroll and the wrap of the movable scroll expands and shrinks during revolutions of the movable scroll.

A seal ring, which is fitted in a seal groove formed in the top surface of the housing, is provided on the back surface side of the movable scroll. A high-pressure fluid in the middle of compression is introduced into a space surrounded by the seal ring, and this causes the end plate of the movable scroll to be pushed against, and hence in pressure contact with, the end plate of the fixed scroll. As a result, the compression chamber is closed and prevents a working fluid, such as a refrigerant, from leaking from the compression chamber.

SUMMARY

Technical Problem

During the revolutions of the movable scroll, the high pressure working fluid in the compression chamber acts against the force pushing the movable scroll toward the fixed scroll, and pushes back the movable scroll. Such a force that pushes back the movable scroll acts as the force that moves the movable scroll in a parallel direction, and as the force that tilts the movable scroll (i.e., tilting moment).

In the known scroll compressors, the back surface of the movable scroll comes in contact with the top surface of the Oldham coupling when the movable scroll is tilted. In other words, the top surface of the Oldham coupling functions as a tilt limiting surface. This tilt limiting surface preferably has a larger surface area so that it can stably receive the tilted movable scroll.

However, in the known scroll compressors, the Oldham coupling is disposed in the vicinity of the outer periphery of the end plate of the movable scroll. Thus, if the surface area of the tilt limiting surface is increased by increasing the outer diameter of the Oldham coupling, it is also necessary to increase the outer diameter of the end plate of the movable scroll, which leads to an increase in size of the device. Further, if the movable scroll is increased in size and weight, the centrifugal force of the movable scroll is increased, and hence the bearing load is also increased, and the balance weight has to be increased to compensate the unbalance of the movable scroll.

In view of the forgoing, it is therefore an object of the present invention to ensure a large surface area of a tilt limiting surface, which is a surface receiving a movable scroll when the movable scroll is tilted, without increasing in size of the device.

Solution to the Problem

The present invention is directed to a scroll compressor, including: a fixed scroll (22); a movable scroll (26) provided on a lower end of the fixed scroll (22) and engaged with the fixed scroll (22); a crank shaft (15) coupled to a back surface side of the movable scroll (26); and a housing (40) disposed under the movable (26) and rotatably supporting the crank shaft (15), and the movable scroll (26) being rotated while pushed toward the fixed scroll (22), due to a high pressure acting on the back surface side of the movable scroll (26) and rotations of the crank shaft (15). The present invention provides the following solutions.

Specifically, a first aspect of the invention is characterized in that an accommodation portion (48) that is recessed and accommodates an Oldham coupling (35) for preventing rotations of the movable scroll (26) on its own axis, is formed in an outer peripheral portion of a top surface of the housing (40), that the housing (40) is provided, in its top surface that is closer to an inner periphery of the housing (40) than the accommodation portion (48), with an inner seal ring groove (45) and an outer seal ring groove (46) in which an inner seal ring (55) and an outer seal ring (56) having different outer diameters are fitted, respectively, that a space on the back surface side of the movable scroll (26) defined by the inner seal ring (55) and the outer seal ring (56) serves as a back pressure chamber (44) into which a high-pressure fluid is introduced and which thereby pushes the movable scroll (26) against the fixed scroll (22), and that a portion of the top surface of the housing (40) defined by the inner seal ring groove (45) and the outer seal ring groove (46) is a step higher than a surface that is closer to the inner periphery of the housing (40) than the inner seal ring groove (45) and a surface that is closer to an outer periphery of the housing (40) than the outer seal ring groove (46), and serves as a tilt limiting surface (43) which is a surface receiving the movable scroll (26) when the movable scroll (26) is tilted.

According to the first aspect of the invention, the Oldham coupling (35) is accommodated in the accommodation portion (48) formed in an outer peripheral portion of the top surface of the housing (40). The housing (40) is provided, in its top surface that is closer to the inner periphery of the housing (40) than the accommodation portion (48), with the inner seal ring groove (45) and the outer seal ring groove (46). A portion of the top surface of the housing (40) defined by the inner seal ring groove (45) and the outer seal ring groove (46) serves as the tilt limiting surface (43) that is a step higher than a surface that is closer to the inner periphery of the housing (40) than the inner seal ring groove (45) and a surface that is closer to the outer periphery of the housing (40) than the outer seal ring groove (46). Thus, if the movable scroll (26) is tilted, the back surface of the movable scroll (26) is received onto the tilt limiting surface (43).

This configuration allows for ensuring a larger surface area of the tilt limiting surface (43), which serves as a surface receiving the movable scroll (26) when the movable scroll (26) is tilted, without increasing the size of the device. Specifically, in the known scroll compressors, when the movable scroll (26) is tilted, the back surface of the movable scroll (26) comes in contact with the top surface of the Oldham coupling. That is, the top surface of the Oldham coupling serves as the tilt limiting surface. The Oldham coupling is disposed in the vicinity of the outer periphery of the end plate of the movable scroll (26). Thus, if the surface area of the tilt limiting surface is increased by increasing the outer diameter of the Oldham coupling, it is also necessary to increase the outer diameter of the end plate of the movable scroll (26), which leads to an increase in size of the device.

In the present invention, on the other hand, the portion of the top surface of the housing (40) defined by the inner seal ring groove (45) and the outer seal ring groove (46), that is, the bottom surface of the back pressure chamber (44) defined by the inner seal ring (55) and the outer seal ring (56), is a step higher than a surface that is closer to the inner periphery of the housing (40) than the inner seal ring groove (45) and a surface that is closer to the outer periphery of the housing (40) than the outer seal ring groove (46), and thus serves as the tilt limiting surface (43). Providing the tilt limiting surface (43) at a position of the housing (40) that is closer to the inner periphery of the housing (40) than the Oldham coupling (35) allows for ensuring a larger surface area of the tilt limiting surface (43) without increasing the size of the device.

A second aspect of the invention is an embodiment of the first aspect of the invention. In the second aspect of the invention, the tilt limiting surface (43) is provided with at least one annular groove (51) recessed along a circumferential direction.

According to the second aspect of the invention, at least one annular groove (51) recessed along the circumference direction is formed in the tilt limiting surface (43). Thus, even if the movable scroll (26) is in close contact, at the start of operation of the scroll compressor, with the tilt limiting surface (43) of the top surface of the housing (40), the high-pressure fluid introduced into the back pressure chamber (44) spreads to the back surface side of the movable scroll (26) along the annular groove (51). This allows for smoothly pushing the movable scroll (26) toward the fixed scroll (22).

A third aspect of the invention is an embodiment of the first or second aspect of the invention. In the third aspect of the invention, the tilt limiting surface (43) is provided with at least one communication groove (52) extending in a radial direction so as to connect the inner seal ring groove (45) and the outer seal ring groove (46).

According to the third aspect of the invention, at least one communication groove (52) extending in the radial direction so as to connect the inner seal ring groove (45) and the outer seal ring groove (46), is formed in the tilt limiting surface (43). Thus, the high-pressure fluid introduced into the back pressure chamber (44) spreads to the back surface side of the movable scroll (26) along the inner seal ring groove (45) and the outer seal ring groove (46) through the communication groove (52). This allows for smoothly pushing the movable scroll (26) toward the fixed scroll (22).

A fourth aspect of the invention is an embodiment of any one of the first to third aspects of the invention. According to the fourth aspect of the invention, the tilt limiting surface (43) is provided with a wear resistance coating.

According to the fourth aspect of the invention, the tilt limiting surface (43) is provided with a wear resistance coating. Thus, the wear resistance of the tilt limiting surface (43) with respect to the movable scroll (26) which collides with the tilt limiting surface (43) every time it is tilted is improved, and this leads to longer life of the device. Examples of the wear resistance coating include a lubrite process (i.e., manganese phosphate coating), electroless nickel plating, DLC coating, and PTFE coating.

A fifth aspect of the invention is an embodiment of any one of the first to fourth aspects of the invention. In the fifth aspect of the invention, the portion of the top surface of the housing (40) defined by the inner seal ring groove (45) and the outer seal ring groove (46) is comprised of a limiting member (53) that is capable of being attached to and detached from the housing (40), and a top surface of the limiting member (53) serves as the tilt limiting surface (43).

According to the fifth aspect of the invention, a portion of the top surface of the housing (40) defined by the inner seal ring groove (45) and the outer seal ring groove (46) is comprised of the limiting member (53) that is capable of being attached to and detached from the housing (40). Since the top surface of the limiting member (53) serves as the tilt limiting surface (43), only the limiting member (53) may be removed and replaced when the tilt limiting surface (43) is worn by the movable scroll (26) which collides with the tilt limiting surface (43) every time it is tilted. This leads to longer life of the device.

Advantages of the Invention

According to the present invention, the bottom surface of the back pressure chamber (44) defined by the inner seal ring (55) and the outer seal ring (56) is a step higher than a surface that is closer to the inner periphery of the housing (40) than the inner seal ring groove (45) and a surface that is closer to the outer periphery of the housing (40) than the outer seal ring groove (46), and this bottom surface of the back pressure chamber (44) serves as the tilt limiting surface (43). This allows for ensuring a larger surface area of the tilt limiting surface (43) without increasing the size of the device.

DESCRIPTION OF EMBODIMENTS

Embodiments of the present invention will be described below with reference to the drawings. The following embodiments are merely preferred examples in nature, and are not intended to limit the scope, applications, and use of the invention.

Figure 1:
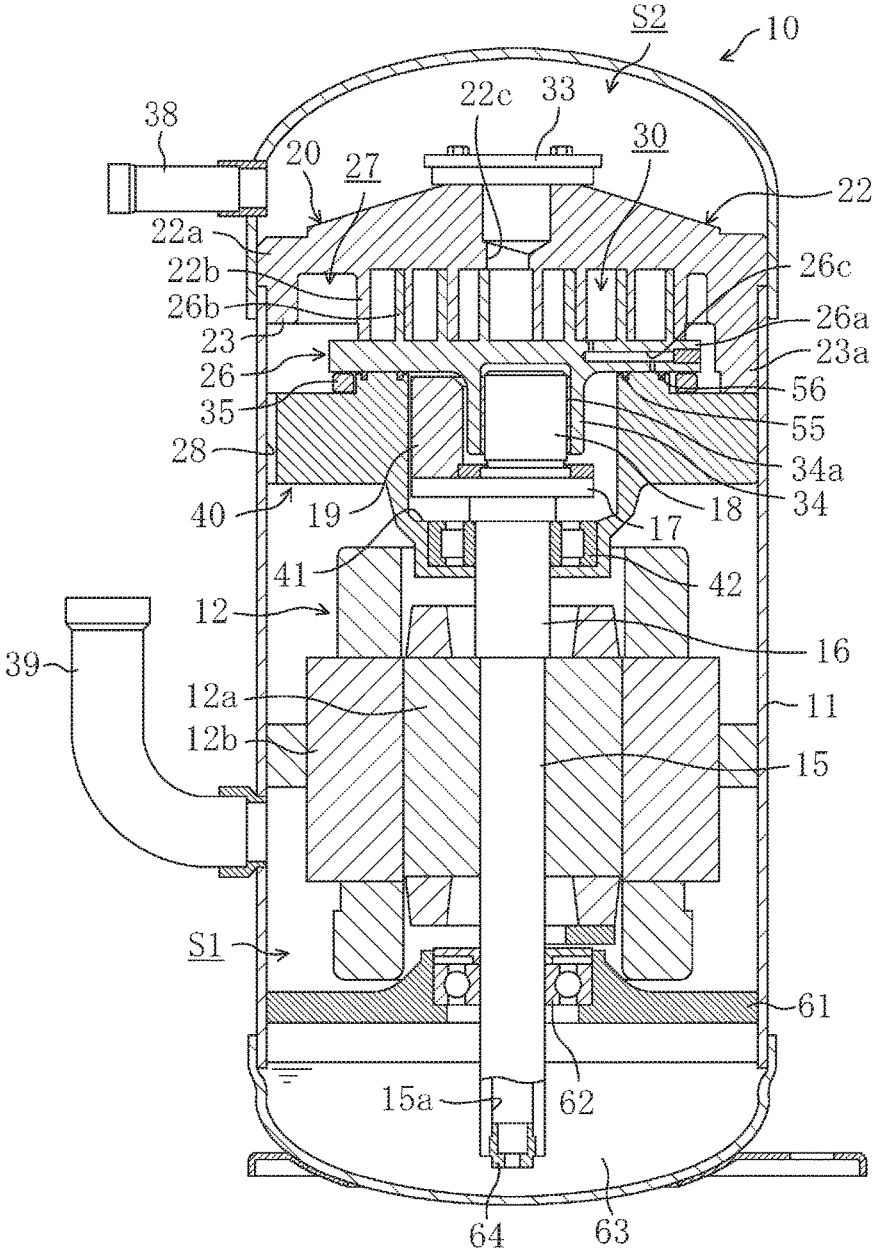
FIG. 1 is a longitudinal cross section illustrating a configuration of a scroll compressor according to an embodiment of the present invention.

FIG. 1 is a longitudinal cross section illustrating a configuration of a scroll. compressor according to an embodiment of the present invention. This scroll compressor (10) is connected, for example, to a refrigerant circuit (not shown) which performs a refrigeration cycle, and is used to compress a refrigerant.

As illustrated in FIG. 1, the scroll compressor (10) is configured as a vertically-oriented, hermetic dome type cylindrical pressure container, and is provided with a casing (11) having an oil reservoir (63) at the bottom. A crank shaft (15) is disposed inside the casing (11). The crank shaft (15) extends vertically in the center of the casing (11). An electric motor (12) for rotating the crank shaft (15) is attached to the crank shaft (15) approximately in the middle in the axial direction. Further, a compression mechanism (20), in which the refrigerant is compressed by the rotation of the crank shaft (15), is coupled to the upper portion of the crank shaft (15).

A suction pipe (39) which sucks a low-pressure refrigerant into the casing (11) is connected to the body of the casing (11). Further, a discharge pipe (38) which discharges a high-pressure refrigerant compressed in the compression mechanism (20) to the outside of the casing (11) is connected to an upper portion of the casing (11). The interior of the casing (11) is partitioned into a low-pressure space (S1) into which the low-pressure refrigerant is sucked, and a high-pressure space (S2) into which the high-pressure refrigerant is discharged.

The electric motor (12) includes a ring-shaped stator (12*b*) fixed to the inner wall surface of the casing (11), and a rotor (12*a*) rotatably installed on the inner peripheral surface of the stator (12*b*). This rotor (12*a*) is to drive the compression mechanism (20) via the crank shaft (15).

The crank shaft (15) includes a main shaft portion (16) attached to the rotor (12*a*), a circular plate-like flanged portion (17) having a larger diameter than the main shaft portion (16) and arranged on the top end surface of the main shaft portion (16), and an eccentric shaft portion (18) having a smaller diameter than the main shaft portion (16), projecting from the top surface of the flanged portion (17), and eccentric with respect to the center of the main shaft portion (16). A balance weight (19) is loaded on the top surface of the flanged portion (17).

When the main shaft portion (16) of the crank shaft (15) rotates, the eccentric shaft portion (18) rotates eccentrically with respect to the main shaft portion (16), and causes a movable scroll (26), described later, of the compression mechanism (20) to revolve via the eccentric shaft portion (18).

A tubular suction member (64) is attached to a lower end portion of the crank shaft (15). The lower end portion of the crank shaft (15), as well as the suction member (64), are soaked in the oil reservoir (63). An oil supply channel (15*a*) is formed in the crank shaft (15) so as to axially pass through the crank shaft (15). The oil supply channel (15*a*) is branched at an intermediate portion of the flow path so that the oil is supplied to a lower bearing (62) and an upper bearing (42) which will be described later. Lubricating oil is sucked up from the oil reservoir (63) through the suction member (64), due to a centrifugal pumping action utilizing the centrifugal force generated in the oil supply channel (15*a*) during the rotation of the crank shaft (15).

A frame (61) is disposed under the electric motor (12), and is fixed to the inner wall surface of the casing (11). The lower bearing (62), which rotatably supports the main shaft portion (16) of the crank shaft (15), is attached to the frame (61).

The compression mechanism (20) has a fixed scroll (22) fixed to the inner wall surface of an upper portion of the casing (11), a movable scroll (26) disposed on the lower end of the fixed scroll (22), and a housing (40) disposed on the lower end of the movable scroll (26).

The fixed scroll (22) includes a fixed-side end plate portion (22*a*) in the shape of a thick disc, an edge portion (23) projecting from an outer peripheral portion of the fixed-side end plate portion (22*a*) toward the housing (40), and a fixed-side wrap (22*b*) projecting toward the movable scroll (26) and arranged in a spiral form. Part of the edge portion (23) is provided with a projection (23*a*) projecting toward, and in contact with, the housing (40). Further, a discharge hole (22*c*) passes through the fixed-side end plate portion (22*a*) in the thickness direction is formed at approximately the center of the fixed-side end plate portion (22*a*).

The movable scroll (26) includes a movable-side end plate portion (26*a*) in the shape of a thick disc, and a movable-side wrap (26*b*) projecting toward the fixed scroll (22) and arranged in a spiral form. A cylindrical boss (34) is integrally formed at a central portion of the back surface of the movable-side end plate portion (26*a*). A bearing (34*a*) is press fitted in the boss (34). The bearing (34*a*) rotatably supports the eccentric shaft portion (18) of the crank shaft (15).

Figure 2:
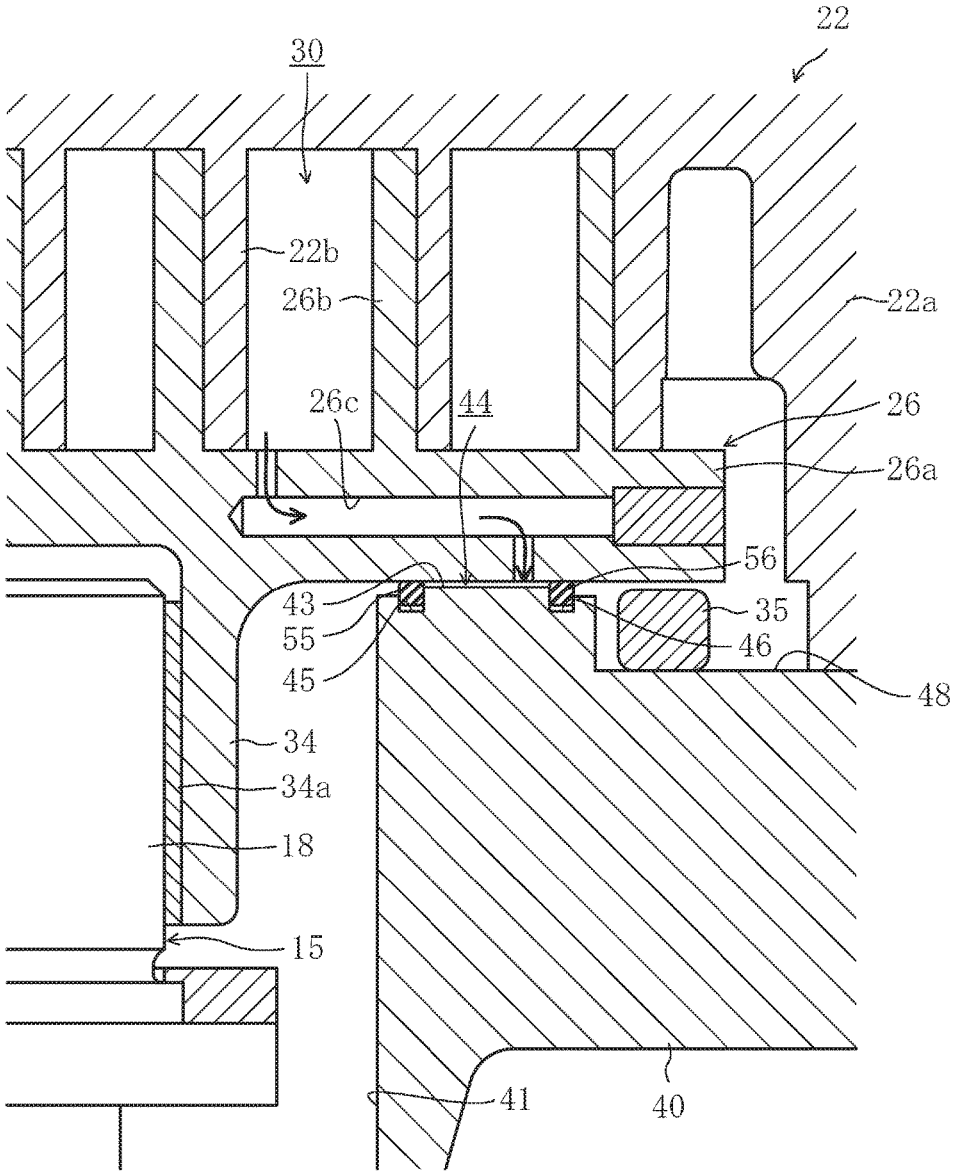
FIG. 2 is a longitudinal cross section illustrating a partially-enlarged configuration of a housing.

As is also illustrated in FIG. 2, the movable-side end plate portion (26*a*) is provided with a supply channel (26*c*) which connects a compression chamber (30) and a back pressure chamber (44), which will be described later, and supplies a high-pressure fluid in the middle of compression into the back pressure chamber (44).

In the compression mechanism (20), the fixed-side wrap (22*b*) and the movable-side wrap (26*b*) are engaged with each other, and the compression chamber (30) for compressing a refrigerant is thereby formed. Further, a suction opening (27) is formed between the edge portion (23) of the fixed-side end plate portion (22*a*) and an outer peripheral portion of the fixed-side wrap (22*b*), and communicates with the compression chamber (30). The suction opening (27) communicates with the low-pressure space (Si) through a communication hole (28) formed in an outer peripheral portion of the housing (40), allowing the low-pressure refrigerant sucked into the low-pressure space (S1) through the suction pipe (39) to flow into the compression chamber (30).

The refrigerant is compressed by the movable scroll (26) revolving around the fixed scroll (22). Further, a central portion of the compression chamber (30) communicates with the high-pressure space (S2) through the discharge hole (22*c*). Thus, the refrigerant compressed in the compression chamber (30) is discharged to the high-pressure space (S2) through the discharge hole (22*c*). A check valve (33) is attached to an open end of the discharge hole (22*c*) to prevent the refrigerant from flowing back to the compression chamber (30).

The outer peripheral surface of the housing (40) is fixed to the inner wall surface of the casing (11). A recessed crank chamber (41) is formed at a central portion of the top surface of the housing (40). The upper bearing (42), which rotatably supports the upper portion of the main shaft portion (16) of the crank shaft (15), is buried in the bottom of the crank chamber(41).

Figure 3:
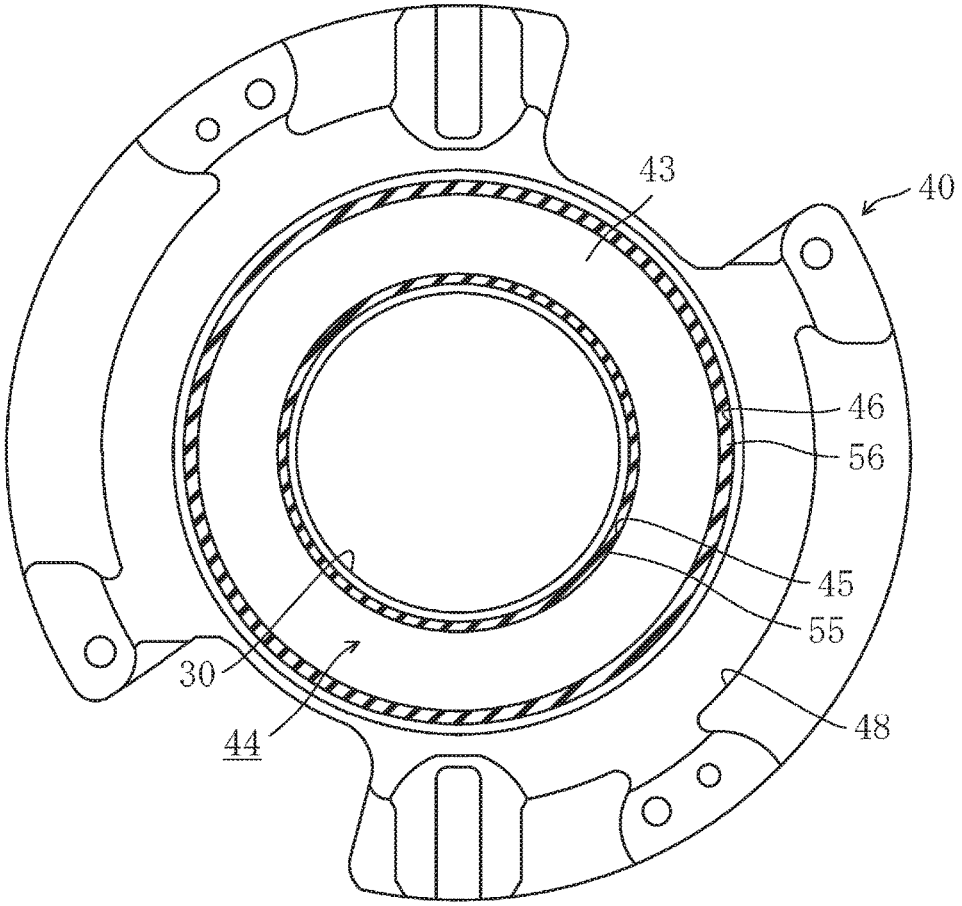
FIG. 3 is a plan view illustrating the configuration of the housing.

As illustrated in FIGS. 2 and 3, a recessed accommodation portion (48) is formed in an outer peripheral portion of the top surface of the housing (40). An Oldham coupling (35) is accommodated in the accommodation portion (48). The Oldham coupling (35) is engaged in a key groove (not shown) formed in the back surface of the movable-side end plate portion (26*a*) of the movable scroll (26) to prevent rotations of the movable scroll (26) on its own axis.

The top surface of the housing (40) is provided with an inner seal ring groove (45) and an outer seal ring groove (46) which have different outer diameters and are concentric with each other. An inner seal ring (55) and an outer seal ring (56) are fitted in the inner seal ring groove (45) and the outer seal ring groove (46), respectively.

The top surfaces of the inner seal ring (55) and the outer seal ring (56) are brought into close contact with the back surface of the movable-side end plate portion (26*a*) of the movable scroll (26). Thus, the back pressure chamber (44) is defined by the back surface of the movable scroll (26), the outer peripheral side of the inner seal ring (55), the inner peripheral side of the outer seal ring (56), and the top surface of the housing (40).

The back pressure chamber (44) communicates with the compression chamber (30) through the supply channel (26*c*) of the movable scroll (26). Thus, when a high-pressure fluid is introduced into the back pressure chamber (44) through the supply channel (26*c*), the high pressure acts on the back surface of the movable scroll (26), and the movable scroll (26) is therefore pushed toward the fixed scroll (22), A portion of the top surface of the housing (40) defined by the inner seal ring groove (45) and the outer seal ring groove (46), that is, the bottom surface of the back pressure chamber (44), is a step higher than a surface that is closer to the inner periphery of the housing (40) than the inner seal ring groove (45) and a surface that is closer to the outer periphery of the housing (40) than the outer seal ring groove (46). This bottom surface of the back pressure chamber (44) functions as a tilt limiting surface (43), which is a surface receiving the movable scroll (26) when the movable scroll (26) is tilted due to a force against the pushing force.

Specifically, during the rotation of the movable scroll (26), the high pressure of the high-pressure fluid in the compression chamber (30) acts against the force pushing the movable scroll (26) toward the fixed scroll (22), and pushes back the movable scroll (26). Such a force that pushes back the movable scroll (26) acts as the force that tilts the movable scroll (26) (i.e., tilting moment), and not as the force that moves the movable scroll (26) in the parallel direction. In other words, the tilt limiting surface (43) comes in contact with the back surface of the movable scroll (26) when the movable scroll (26) is pushed back by the force against the pushing force toward the fixed scroll (22), thereby limiting further tilting of the movable scroll (26).

The tilt limiting surface (43) is provided with a wear resistance coating. Examples of the wear resistance coating include a lubrite process manganese phosphate coating), electroless nickel plating, DLC coating, and PTFE coating. Thus, the wear resistance of the tilt limiting surface (43) with respect to the movable scroll (26) which collides with the tilt limiting surface (43) every time it is tilted is improved, and this leads to longer life of the device.

Now, the operation of the scroll compressor (10) will be described. First, when the electric motor (12) is activated, the crank shaft (15) is rotated due to the rotation of the rotor (12*a*). The torque of the crank shaft (15) is transmitted to the movable scroll (26) via the eccentric shaft portion (18), but the movable scroll (26) does not rotate on its own axis but only revolves around the rotation center of the crank shaft (15), since the Oldham coupling (35) regulates the rotation of the movable scroll (26) on its own axis. The capacity of the compression chamber (30) varies due to the revolution of the movable scroll (26).

Specifically, when the capacity of the compression chamber (30) is increased, the low-pressure refrigerant sucked into the low-pressure space (S1) of the casing (11) through the suction pipe (39) is sucked into the compression chamber (30) from the communication hole (28) through the suction opening (27), and the refrigerant is compressed in the compression chamber (30). The compressed refrigerant having a high pressure is discharged from the discharge hole (22*c*) and fills the high-pressure space (S2). After that, the high-pressure refrigerant is discharged to the outside of the casing (11) through the discharge pipe (38).

Part of the high-pressure refrigerant compressed in the compression chamber (30) is introduced into the back pressure chamber (44) through the supply channel (26*c*) formed in the movable-side end plate portion (26*a*) of the movable scroll (26). Thus, the movable scroll (26) is rotated while pushed against the fixed scroll (22). The tilting of the movable scroll (26) is limited even if the movable scroll (26) is pushed back toward the housing (40) by the force against this pushing force toward the fixed scroll (22), since the back surface of the movable scroll (26) comes in contact with the tilt limiting surface (43).

During the operation of the scroll compressor (10), the lubricating oil in the oil reservoir (63) is supplied to the bearing (34*a*) through the oil supply channel (15*a*), and is also supplied to the upper bearing (42) and the lower bearing (62) through a branch flow path not shown in the drawings.

As described above, according to the scroll compressor (10) of the present embodiment, a portion of the top surface of the housing (40) defined by the inner seal ring groove (45) and the outer seal ring groove (46), that is, the bottom surface of the back pressure chamber (44) defined by the inner seal ring (55) and the outer seal ring (56), is a step higher than the surface that is closer to the inner periphery of the housing (40) than the inner seal ring groove (45) and the surface that is closer to the outer periphery than the outer seal ring groove (46), and this raised surface functions as the tilt limiting surface (43). Forming the tilt limiting surface (43) on the housing (40) at a location closer to the inner periphery of the housing (40) than the Oldham coupling (35) is, allows for ensuring a larger surface area of the tilt limiting surface (43) without increasing the size of the device.

<<First Variation>>

Figure 4:
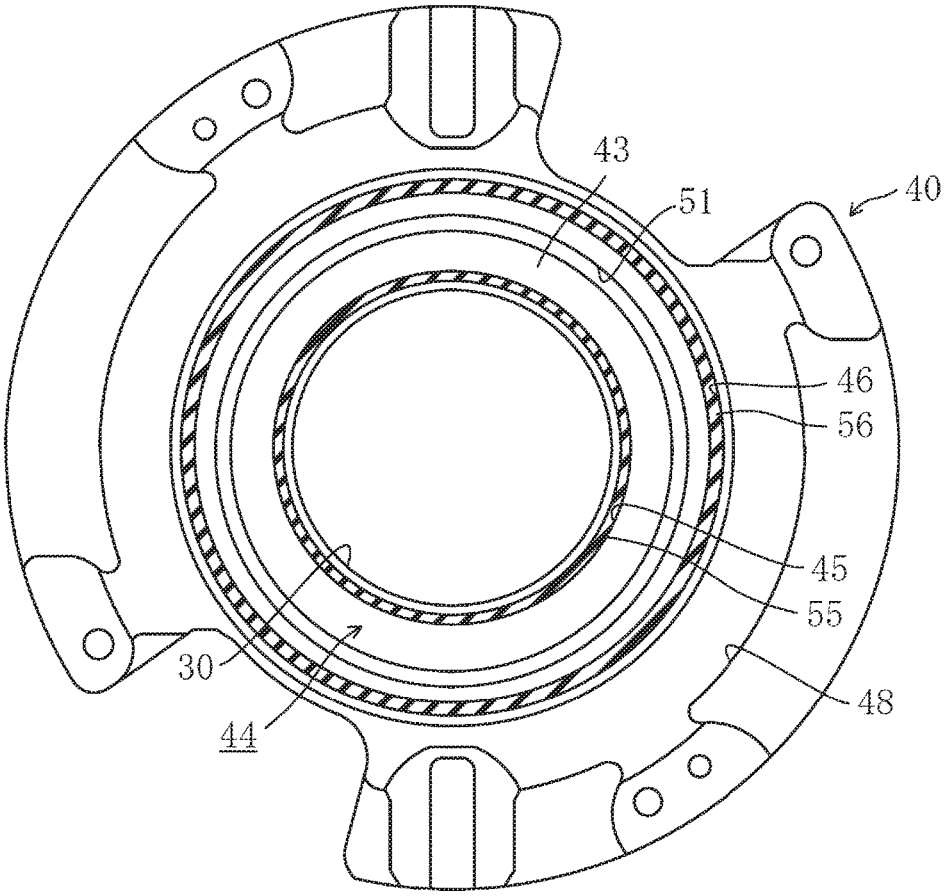
FIG. 4 is a plan view illustrating a configuration of a housing according to a first variation.

FIG. 4 is a plan view illustrating a configuration of a housing according to the first variation. In the drawing, the same reference characters are used to designate the same elements as those in the above embodiment, and only the differences will be explained.

As illustrated in FIG. 4, the tilt limiting surface (43) formed at the top surface of the housing (40) is provided with an annular groove (51) that is recessed along the circumferential direction. The annular groove (51) is concentric the inner seal ring groove (45) and the outer seal ring groove (46).

Due to this configuration, even if the movable scroll (26) is in close contact, at the start of operation of the scroll compressor (10), with the tilt limiting surface (43) formed at the top surface of the housing (40), the high-pressure fluid introduced into the back pressure chamber (44) spreads to the back surface of the movable scroll (26) along the annular groove (51). This allows for smoothly pushing the movable scroll (26) toward the fixed scroll (22).

In the present first variation, an embodiment in which only one annular groove (51) is formed is described. However, a plurality of annular grooves (51) may be formed.

<<Second Variation>>

Figure 5:
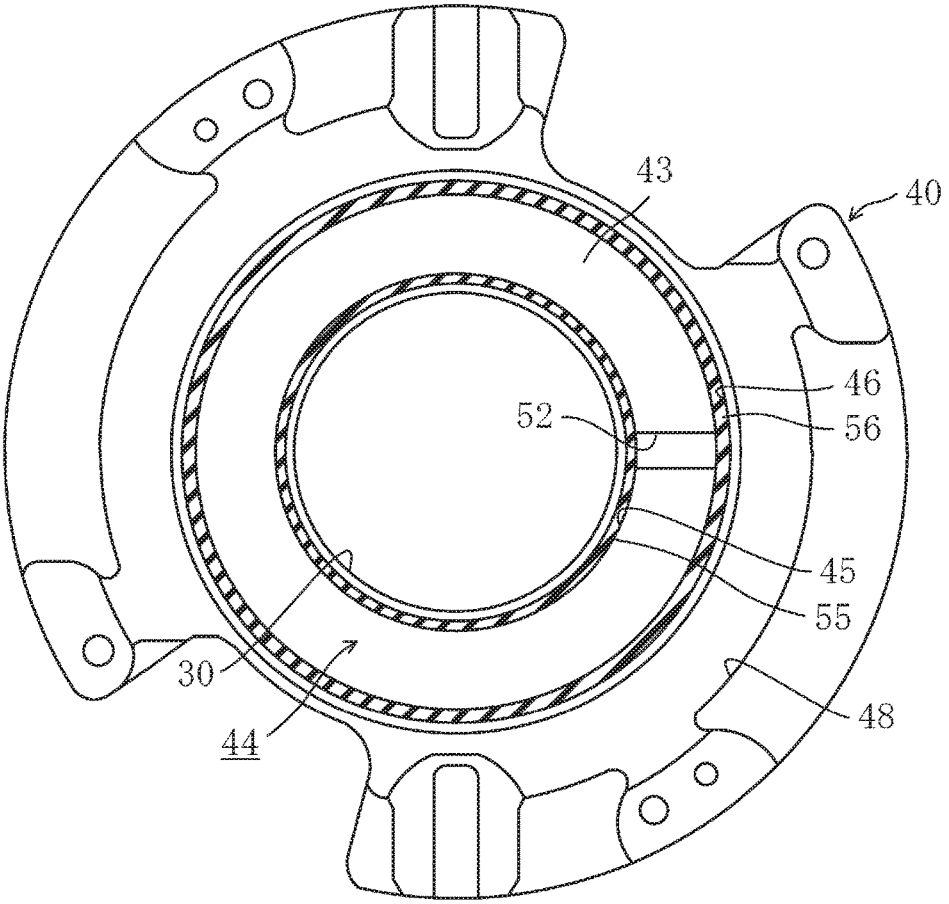
FIG. 5 is a plan view illustrating a configuration of a housing according to a second variation.

FIG. 5 is a plan view illustrating a configuration of a housing according to the second variation. In the drawing, the same reference characters are used to designate the same elements as those in the above embodiment, and only the differences will be explained.

As illustrated in FIG. 5, the tilt limiting surface (43) formed at the top surface of the housing (40) is provided with a communication groove (52) extending in a radial direction so as to connect the inner seal ring groove (45) and the outer seal ring groove (46).

Due to this configuration, the high-pressure fluid introduced into the back pressure chamber (44) spreads to the back surface of the movable scroll (26) along the inner seal ring groove (45) and the outer seal ring groove (46), through the communication groove (52). This allows for smoothly pushing the movable scroll (26) toward the fixed scroll (22).

In the present second variation, an embodiment in which only one communication groove (52) is formed is described. However, a plurality of communication grooves (52) which are spaced apart from each other in the circumferential direction may be formed.

<<Third Variation>>

Figure 6:
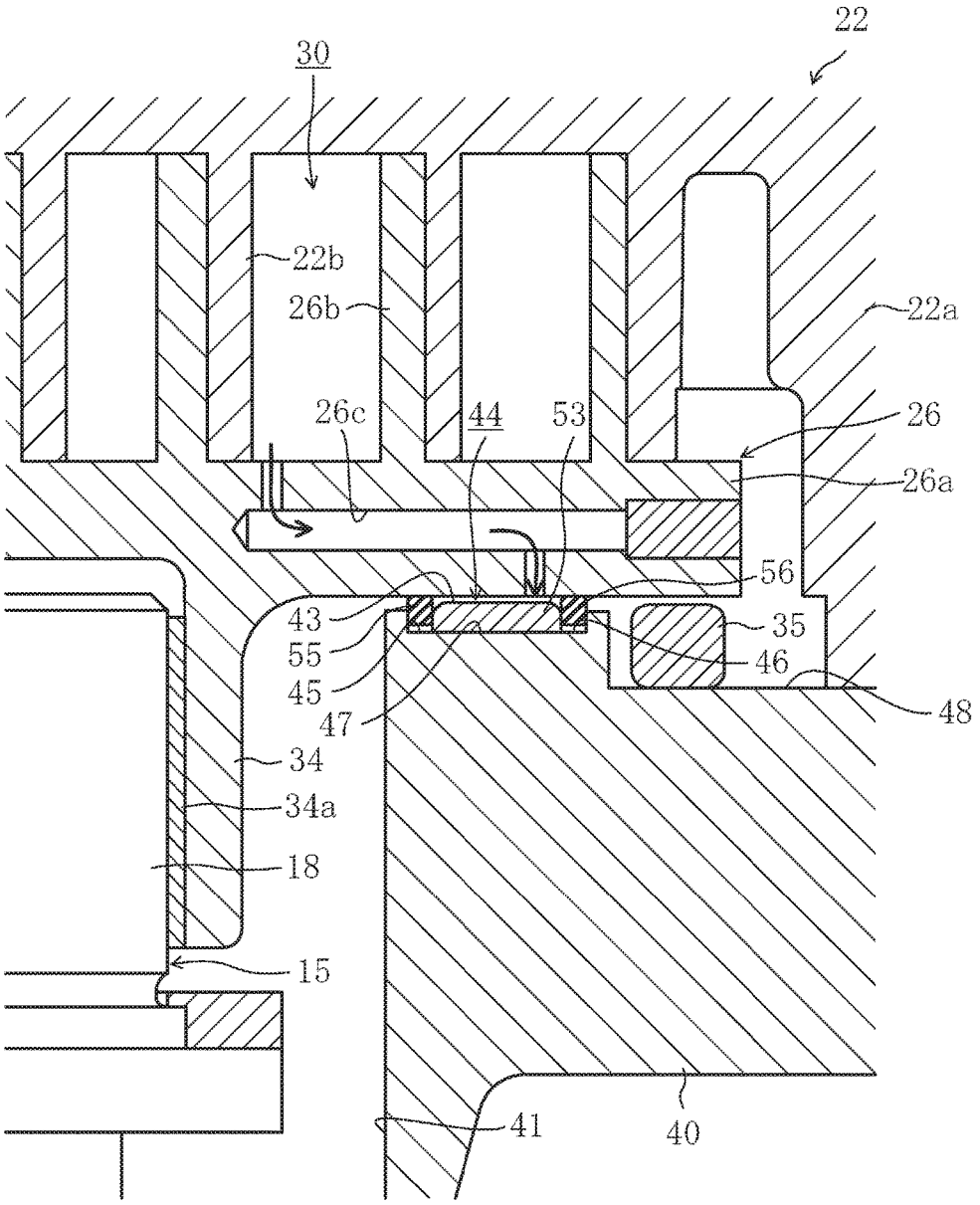
FIG. 6 is a longitudinal cross section illustrating a partially-enlarged configuration of a housing according to a third variation.

FIG. 6 is a longitudinal cross section illustrating a partially-enlarged configuration of a housing according to the third variation. In the drawing, the same reference characters are used to designate the same elements as those in the above embodiment, and only the differences will be explained.

As illustrated in FIG. 6, the top surface of the housing (40) is provided with a recessed groove (47). A ring-shaped limiting member (53) is accommodated in the recessed groove (47). The limiting member (53) is detachably fixed to the housing (40) with a fastening bolt or a pin (not shown), for example.

The width of the ring-shaped limiting member (53) is designed to be smaller than the width of the recessed groove (47). This configuration provides the inner seal ring groove (45) between the inner peripheral wall of the recessed groove (47) and the inner peripheral wall of the limiting member (53), and the outer seal ring groove (46) between the outer peripheral wall of the recessed groove (47) and the outer peripheral wall of the limiting member (53). The inner seal ring (55) and the outer seal ring (56) are fitted in the inner seal ring groove (45) and the outer seal ring groove (46), respectively.

The plate thickness of the limiting member (53) is larger than the depth of the recessed groove (47). This configuration makes the top surface of the limiting member (53) a step higher than the top surface of the housing (40), and this raised surface functions as the tilt limiting surface (43).

Since the top surface of the limiting member (53) serves as the tilt limiting surface (43), only the limiting member (53) may be removed and replaced when the tilt limiting surface (43) is worn by the movable scroll (26) which collides with the tilt limiting surface (43) every time it is tilted. This leads to longer life of the device.

INDUSTRIAL APLICABILITY

As can be seen from the foregoing, the present invention is very useful and have high industrial applicability due to its highly practical advantages that a larger surface area of the tilt limiting surface, which functions as a surface receiving the movable scroll when the movable scroll is tilted, can be ensured without increasing the size of the device.

What is claimed is:

1. A scroll compressor, comprising:

a fixed scroll;

a movable scroll provided on a lower end of the fixed scroll and engaged with the fixed scroll;

a crank shaft coupled to a back surface side of the movable scroll; and a housing disposed under the movable scroll and rotatably supporting the crank shaft, the movable scroll being movable due to rotations of the crank shaft while being pushed toward the fixed scroll due to a high pressure acting on the back surface side of the movable scroll, an outer peripheral portion of a top surface of the housing having an accommodation portion formed therein, the accommodation portion being recessed and accommodating an Oldham coupling preventing rotations of the movable scroll around an axis thereof, the housing having, in the top surface of the housing that is closer to an inner periphery of the housing than the accommodation portion, an inner seal ring groove with an inner seal ring fitted therein, and an outer seal ring groove with an outer seal ring fitted therein, the inner and out seal rings having different outer diameters, a space on the back surface side of the movable scroll defined by the inner seal ring and the outer seal ring serving as a back pressure chamber into which a high-pressure fluid is introduced to push the movable scroll against the fixed scroll, an intermediate portion of the top surface of the housing connecting the inner seal ring groove and the outer seal ring groove being higher than an inner portion of the top surface of the housing that is closer to the inner periphery of the housing relative to the inner seal ring groove and an outer portion of the top surface that is closer to an outer periphery of the housing relative to the outer seal ring groove, and the intermediate, portion of the top surface of the housing connecting the inner seal ring groove and the outer seal ring groove serving as a tilt limiting surface arranged and configured to contact the movable scroll when the movable scroll is tilted.

2. The scroll compressor of claim 1, wherein the tilt limiting surface includes at least one annular groove recessed along a circumferential direction.

3. The scroll compressor of claim 2, wherein the tilt limiting surface includes at least one communication groove extending in a radial direction so as to connect the inner seal ring groove and the outer seal ring groove.

4. The scroll compressor of claim 3, wherein the tilt limiting surface includes a wear resistance coating.

5. The scroll compressor of claim 4, wherein the portion of the top surface of the housing defined by the inner seal ring groove and the outer seal ring groove includes a limiting ring attachable to and detachable from the housing, and a top surface of the limiting ring serves as the tilt limiting surface.

6. The scroll compressor of claim 3, wherein the portion of the top surface of the housing defined by the inner seal ring groove and the outer seal ring groove includes a limiting ring attachable to and detachable from the housing, and a top surface of the limiting ring serves as the tilt limiting surface.

7. The scroll compressor of claim 2, wherein the tilt limiting surface includes a wear resistance coating.

8. The scroll compressor of claim 7, wherein the portion of the top surface of the housing defined by the inner seal ring groove and the outer seal ring groove includes a limiting ring attachable to and detachable from the housing, and a top surface of the limiting ring serves as the tilt limiting surface.

9. The scroll compressor of claim 2, wherein the portion of the top surface of the housing defined by the inner seal ring groove and the outer seal ring groove includes a limiting ring attachable to and detachable from the housing, and a top surface of the limiting ring serves as the tilt limiting surface.

10. The scroll compressor of claim 1, wherein the tilt limiting surface includes at least one communication groove extending in a radial direction so as to connect the inner seal ring groove and the outer seal ring groove.

11. The scroll compressor of claim 10, wherein the tilt limiting surface includes a wear resistance coating.

12. The scroll compressor of claim 11, wherein the portion of the top surface of the housing defined by the inner seal ring groove and the outer seal ring groove includes a limiting ring attachable to and detachable from the housing, and a top surface of the limiting ring serves as the tilt limiting surface.

13. The scroll compressor of claim 10, wherein the portion of the top surface of the housing defined by the inner seal ring groove and the outer seal ring groove includes a limiting ring attachable to and detachable from the housing, and a top surface of the limiting ring serves as the tilt limiting surface.

14. The scroll compressor of claim 1, wherein the tilt limiting surface includes a wear resistance coating.

15. The scroll compressor of claim 14, wherein the portion of the top surface of the housing defined by the inner seal ring groove and the outer seal ring groove includes a limiting ring attachable to and detachable from the housing, and a top surface of the limiting ring serves as the tilt limiting surface.

16. The scroll compressor of claim 1, wherein the portion of the top surface of the housing defined by the inner seal ring groove and the outer seal ring groove includes a limiting ring attachable to and detachable from the housing, and a top surface of the limiting ring serves as the tilt limiting surface.

* * * * *